US008291550B2

(12) United States Patent
Yang

(10) Patent No.: US 8,291,550 B2
(45) Date of Patent: Oct. 23, 2012

(54) HINGE AND DISPLAY APPARATUS USING THE SAME

(75) Inventor: Wen-Yan Yang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 593 days.

(21) Appl. No.: 12/494,215

(22) Filed: Jun. 29, 2009

(65) Prior Publication Data

US 2010/0299879 A1 Dec. 2, 2010

(30) Foreign Application Priority Data

Jun. 2, 2009 (CN) ..... 2009 1 0302844

(51) Int. Cl.
*E05C 17/64* (2006.01)

(52) U.S. Cl. ..... 16/342; 16/387; 361/679.27; 248/919

(58) Field of Classification Search ..... 16/342, 16/337–339, 386, 387, 374; 361/679.27; 455/575.3; 379/433.13; 248/919, 922, 923; 403/167, 230

See application file for complete search history.

(56) References Cited

U.S. PATENT DOCUMENTS

| | | | | |
|---|---|---|---|---|
| 6,470,532 | B2 * | 10/2002 | Rude | 16/335 |
| 6,584,646 | B2 * | 7/2003 | Fujita | 16/342 |
| 6,983,514 | B2 * | 1/2006 | Lu et al. | 16/342 |
| 7,578,032 | B2 * | 8/2009 | Chen | 16/374 |
| 8,074,322 | B2 * | 12/2011 | Wang et al. | 16/342 |
| 2006/0288535 | A1 * | 12/2006 | Lu et al. | 16/387 |
| 2007/0136996 | A1 * | 6/2007 | Chen et al. | 16/342 |
| 2011/0072620 | A1 * | 3/2011 | Wang et al. | 16/342 |

* cited by examiner

*Primary Examiner* — William L. Miller
(74) *Attorney, Agent, or Firm* — Altis Law Group, Inc.

(57) ABSTRACT

A hinge used in a display apparatus is provided. The display apparatus includes a display unit, and a seat. The hinge is used for connected the display unit to the seat. The hinge includes a pivot rod, a first connection member, a second connection member, and a support member. The first connection member is fixed to the display unit and further connected to the pivot rod. The second connection member is connected to the support member. The second connection member is fixed to the support member and further pivotally connected to the pivot rod. The support member is fix to the seat and further pivotally connected to the pivot rod.

9 Claims, 3 Drawing Sheets

HINGE AND DISPLAY APPARATUS USING THE SAME

BACKGROUND

1. Technical Field

The disclosure relates to hinges, and more particularly, to a hinge used in a display apparatus.

2. Description of Related Art

With the ever increasing size of displays, the weight of the display also increases. Therefore, what is needed is a hinge capable of supporting heavier displays.

BRIEF DESCRIPTION OF THE DRAWINGS

The components of the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

Figure 1:
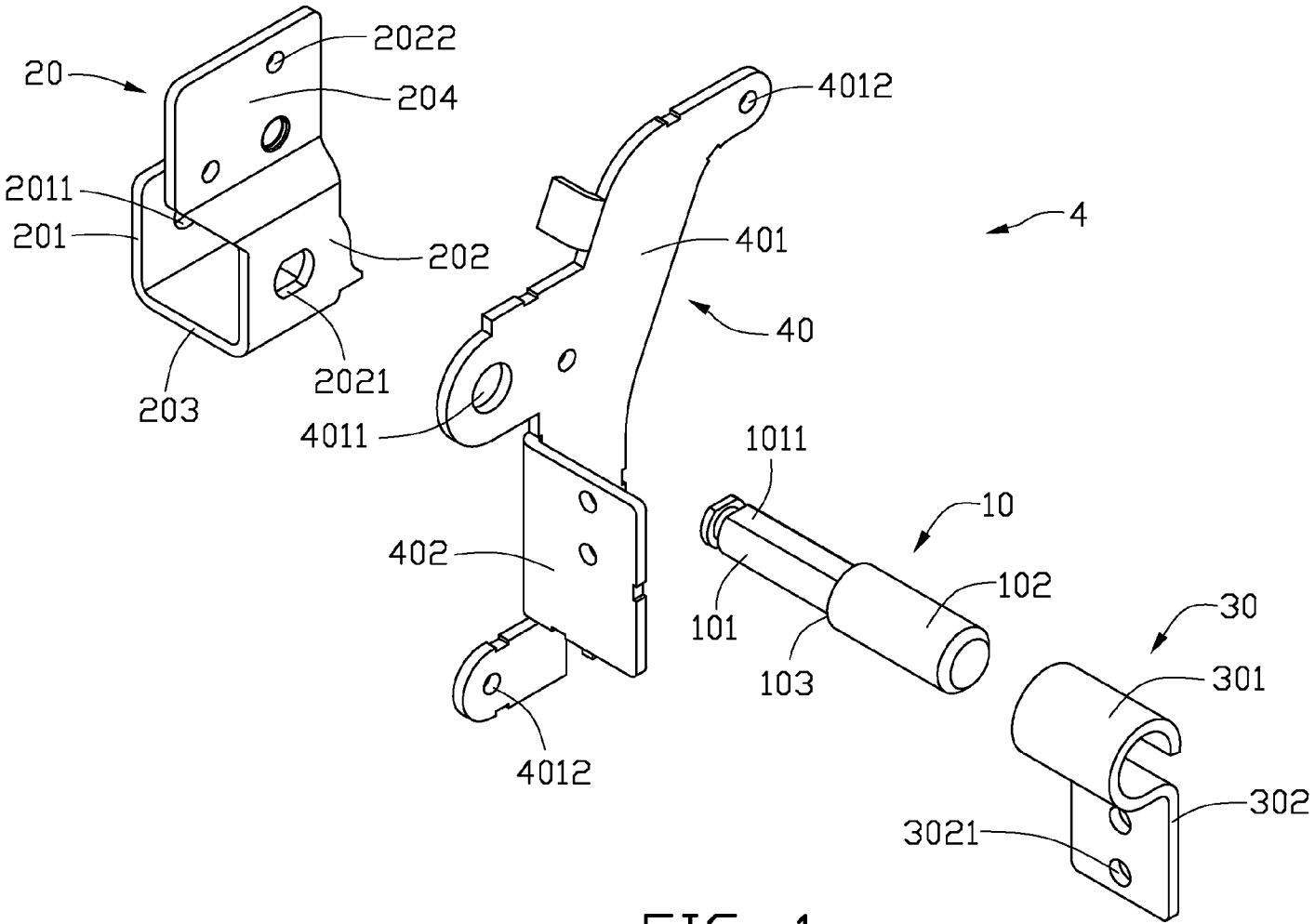
FIG. 1 is an exploded perspective view of a hinge in accordance with one embodiment.
Figure 2:
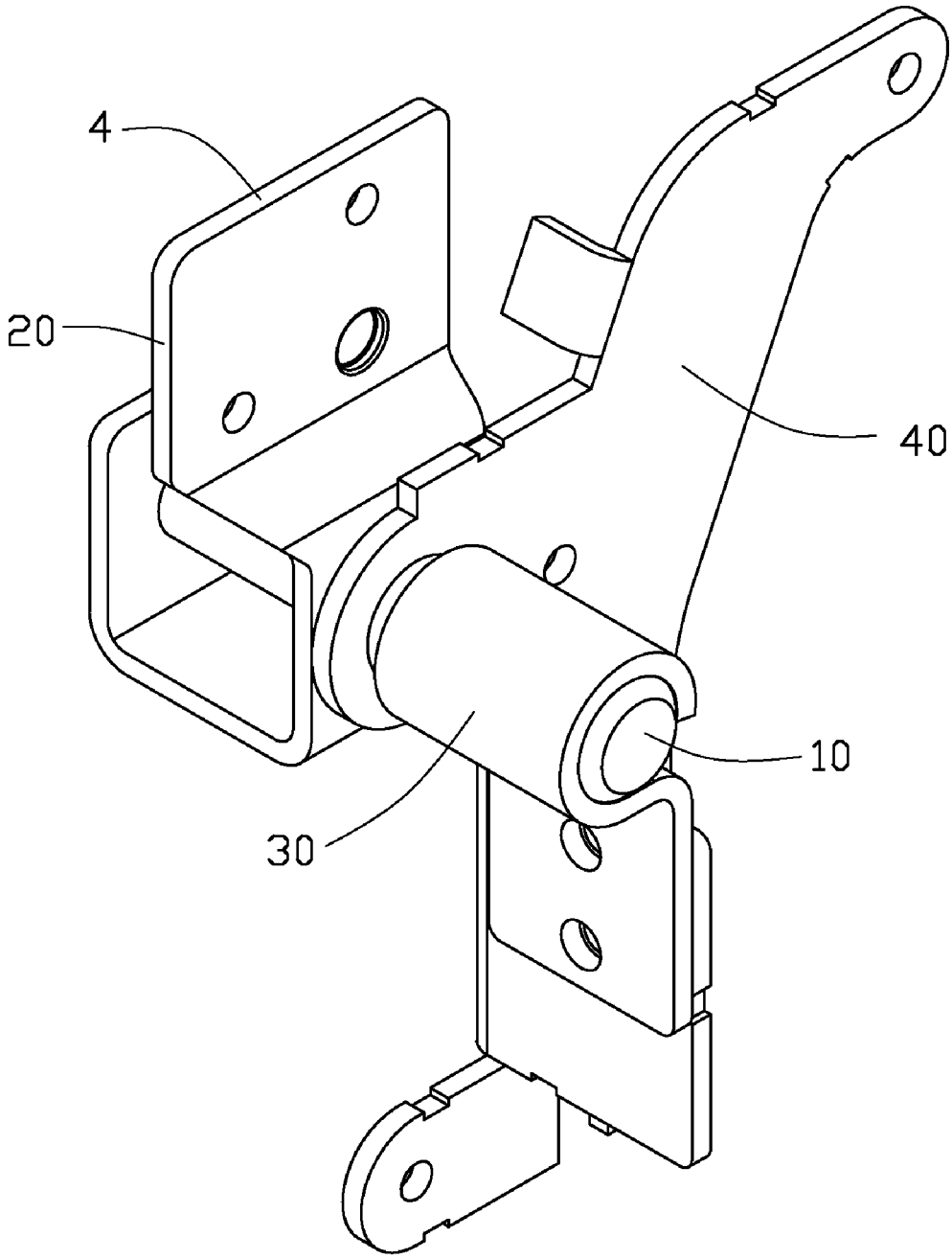
FIG. 2 is an assembled view of the hinge of FIG. 1.
Figure 3:
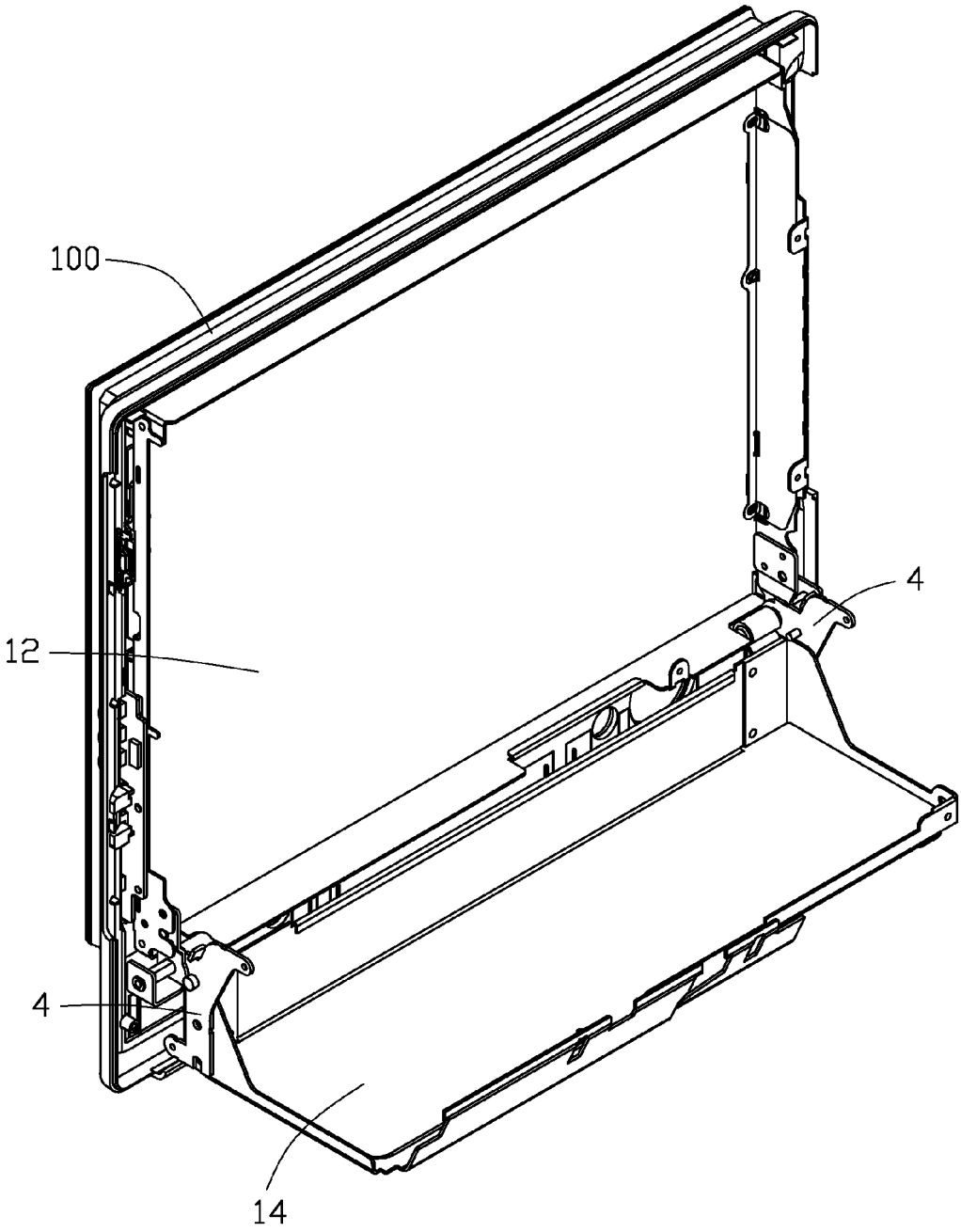
FIG. 3 is a perspective view illustrating a state of the hinge of FIG. 1 used in one embodiment of a display apparatus.

Referring to FIG. 1 a hinge 4 includes a pivot rod 10, a first connection member 20, a second connection member 30, and a support member 40. Referring also to FIG. 3, a display apparatus 100 includes a display unit 12 and a seat 14 connected to the display unit 12 via the hinge 4. The first connection member 20, the second connection member 30, and the support member 40 are connected to the pivot rod 10. The first connection member 20 is fixed to the display unit 12, the display unit 12 is also connected to the support member 40, and the support member 40 is to the seat 14.

The pivot rod 10 includes a first cylindrical portion 101 and a second cylindrical portion 102. A diameter of the second cylindrical portion 102 is larger than a diameter of the first cylindrical portion 101, thus forming a shoulder 103. The first cylindrical portion 101 has a portion removed to form a substantially flat surface 1011 which extends along the axis of the first cylindrical portion 101.

The first connection member 20 includes a first sidewall 201, a second sidewall 202, a joint portion 203 connecting the first sidewall 201 to the second sidewall 202, and an attachment wall 204. A through hole 2022 is defined in the attachment wall 204. A space is formed between the first sidewall 201 and the second sidewall 202. A first hole 2011 is defined in the first sidewall 201, and a second hole 2021 is defined in the second sidewall 202. The shape of the first and second holes 2011, 2021 and the cross-sectional shape of the first cylindrical portion 101 are substantially the same.

The second connection member 30 includes a cylindrical wall 301 and a flat plate portion 302 connected to one end of the cylindrical wall 301. A through hole 3021 is defined in the flat plate portion 302.

The support member 40 includes a fixing plate portion 401 and a connection plate portion 402. The fixing plate portion 401 is substantially perpendicular to the connection plate portion 402. A round hole 4011 is defined in the fixing plate portion 401 and a pair of through holes 4012 are defined at opposite ends of the fixing plate portion 401.

In assembly, the pivot rod 10 is extended through the round hole 4011, the second hole 2021, and the first hole 2011 in turn. The first connection member 20 and the support member 40 are connected to the first cylindrical portion 101, and the second cylindrical portion 102 is accommodated by the cylindrical wall 301, while the flat plate portion 302 is connected to the connection plate portion 402. In one embodiment, rivets (not shown) extend through the hole 3021 to connect the second connection member 30 to the support member 40. The second connection member 30 may also be connected to the support member 40 by other means, such as soldering.

After assembly, the support member 40 is locked by the shoulder 103 and the first connection member 20. Accordingly, the support member 40 can only rotate relative to the pivot rod 10. A bolt (not shown) connected to the end of the first cylindrical portion 101 cooperates with the support member 40 to limit the first connection member 20 to move along the axis of the pivot rod 10. The first connection member 20 cannot rotate after being connected to the first cylindrical portion 101, because the flat surface 1011 is formed in the first cylindrical portion 101, and the shape of the first and second holes 2011, 2021 and the cross-sectional shape of the first cylindrical portion 101 are the same. In addition, since the second connection member 30 is connected to the support member 40, the second member 30 and the support member 40 can rotate relative to the pivot rod 10.

Referring to FIG. 3, the display unit 12 is connected to the seat 14 by the hinge 4. Specifically, a fastener (not shown) can extend through the through hole 2022 of the first connecting member 20 to fix the first connection member 20 to the display unit 12. An additional fastener can extend through the through hole 4012 of the support member 40 to fix the support member 40 to the seat 14. Additionally, the hinge 14 can also be connected to the display unit 12 and to the seat 14 by soldering or other means.

After the display unit 12 and the seat 14 are assembled together via the hinge 4, the angle of the display unit 12 can be adjusted by firstly rotating the display unit 12 to a desired angle. Accordingly, the first connection member 20 connected to the display unit 12, as well as the pivot rod 10, is driven to rotate. The first connection member 20 further drives the pivot rod 10 to rotate relative to the support member 40.

During the process of rotating the display unit 12, the support member 40 fixed to the seat 14 which does not move. The first connection member 20 together with the pivot rod 10 rotate relative to the seat 14 but not to the display unit 12.

Additionally, the hinge 4 can support a heavy display unit 12 because of the space formed between the first sidewall 101 and the second sidewall 102, and most of the second cylindrical portion 102 is accommodated by the cylindrical wall 301.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A hinge for connecting a display unit to a seat, comprising:

a pivot rod, comprising:

a first cylindrical portion; and a second cylindrical portion connected to the first cylindrical portion, wherein a diameter of the second cylindrical portion is larger than that of the first cylindrical portion;

a first connection member fixed to the display unit and connected to the first cylindrical portion of the pivot rod;

a support member connected to the seat and pivotally connected to the first cylindrical portion of the pivot rod; and a second connection member fixed to the support member and pivotably connected to the second cylindrical portion of the pivot rod.

2. The hinge as described in claim 1, wherein the first connection member comprises a first sidewall defining a first hole, a second sidewall defining a second hole, and a joint portion joining the first sidewall to the second sidewall; wherein the pivot rod extends through the first hole and the second hole.

3. The hinge as described in claim 1, wherein the first cylindrical portion has a flat surface extending along an axis of the first cylindrical portion.

4. The hinge as described in claim 1, wherein the second connection member comprises a cylindrical wall coiled around the second cylindrical portion.

5. A display apparatus, comprising:

a display unit;

a seat; and a hinge connecting the display unit to the seat, the hinge comprising;

a pivot rod, comprising:

a first cylindrical portion; and a second cylindrical portion connected to the first cylindrical portion, wherein a diameter of the second cylindrical portion is larger than that of the first cylindrical portion;

a support member fixed to the seat and pivotally connected to the first cylindrical portion of the pivot rod;

a first connection member fixed to the display unit and connected to the first cylindrical portion of the pivot rod; and a second connection member connected to the support member and pivotally connected to the second cylindrical portion of the pivot rod.

6. The displaying apparatus as described in claim 5, wherein the first connection member comprises a first sidewall defining a first hole, a second sidewall defining a second hole, and a joint portion joining the first sidewall to the second sidewall; wherein the pivot rod extends through the first hole and the second hole.

7. The display apparatus as described in claim 5, wherein the first cylindrical portion has a flat surface extending along an axis of the first cylindrical portion.

8. The display apparatus as described in claim 7, wherein the second connection member comprises a cylindrical wall coiled around the second cylindrical portion.

9. A hinge for connecting a display unit to a seat, comprising:

a first connection member fixed to the display unit, the first connection member comprising:

a first sidewall defining a first hole;

a second sidewall defining a second hole; and a joint portion joining the first sidewall to the second sidewall;

a pivot rod extending through the first hole and the second hole;

a support member connected to the seat and pivotably connected to the pivot rod; and a second connection member fixed to the support member and pivotably connected to the pivot rod.

* * * * *